US008995870B2

(12) United States Patent
Morishita

(10) Patent No.: US 8,995,870 B2
(45) Date of Patent: Mar. 31, 2015

(54) BELT CLEANING DEVICE AND IMAGE FORMING APPARATUS HAVING THE SAME

(71) Applicant: KYOCERA Document Solutions Inc., Osaka (JP)

(72) Inventor: Hiroki Morishita, Osaka (JP)

(73) Assignee: KYOCERA Documents Solutions Inc., Osaka (JP)

( * ) Notice: Subject to any disclaimer, the term of this patent is extended or adjusted under 35 U.S.C. 154(b) by 0 days.

(21) Appl. No.: 14/191,323

(22) Filed: Feb. 26, 2014

(65) Prior Publication Data

US 2014/0241751 A1 Aug. 28, 2014

(30) Foreign Application Priority Data

Feb. 28, 2013 (JP) ..... 2013-040159

(51) Int. Cl.
*G03G 15/16* (2006.01)
*G03G 21/00* (2006.01)

(52) U.S. Cl.
CPC ..... *G03G 15/161* (2013.01); *G03G 2215/1661* (2013.01)
USPC ..... 399/101; 399/357

(58) Field of Classification Search
CPC ..... G03G 15/161; G03G 15/168; G03G 21/0058; G03G 2215/1661; G03G 2221/0089; G03G 2221/0015
USPC ..... 399/71, 98, 101, 357, 358; 198/494, 198/496–498; 474/92
See application file for complete search history.

(56) References Cited

U.S. PATENT DOCUMENTS

| | | | | |
|---|---|---|---|---|
| 4,982,239 | A * | 1/1991 | Kume et al. | 399/349 |
| 7,903,999 | B2 * | 3/2011 | Kinokuni et al. | 399/149 |
| 2006/0269322 | A1 * | 11/2006 | Tanaka | 399/128 |
| 2007/0020005 | A1 * | 1/2007 | Shigezaki et al. | 399/349 |
| 2012/0163866 | A1 | 6/2012 | Morishita | |

FOREIGN PATENT DOCUMENTS

| | | | |
|---|---|---|---|
| JP | 08272271 | A * | 10/1996 |
| JP | 10293512 | A * | 11/1998 |
| JP | 11150968 | A * | 6/1999 |
| JP | 2000075599 | A * | 3/2000 |
| JP | 2000187416 | A * | 7/2000 |
| JP | 2000315004 | A * | 11/2000 |
| JP | 2010091865 | A * | 4/2010 |
| JP | 2011191624 | A * | 9/2011 |
| JP | 2012-133268 | | 7/2012 |

* cited by examiner

*Primary Examiner* — Robert Beatty
(74) *Attorney, Agent, or Firm* — Knobbe, Martens, Olson & Bear LLP

(57) ABSTRACT

A belt cleaning device includes a collection roller, a cleaning blade, a sealing member, a first thrust mechanism, and a second thrust mechanism. The collection roller collects remaining toner on an intermediate transfer belt. The cleaning blade extends along the collection roller and scrapes off the toner of a surface of the collection roller. The sealing member softly comes into contact with the surface of the collection roller and prevents counterflow of the toner. The first thrust mechanism displaces the collection roller in its rotating shaft direction by a rotational driving force transmitted to the collection roller and the second thrust mechanism thrusts the cleaning blade in the rotating shaft direction of the collection roller in a thrust cycle shorter than that of the collection roller based on the first thrust mechanism.

5 Claims, 15 Drawing Sheets

BELT CLEANING DEVICE AND IMAGE FORMING APPARATUS HAVING THE SAME

INCORPORATION BY REFERENCE

This application claims priority to Japanese Patent Application No. 2013-40159 filed on Feb. 28, 2013, the entire contents of which are incorporated by reference herein.

BACKGROUND

The present disclosure relates to a belt cleaning device and an image forming apparatus having the same.

Electrophotographic image forming apparatuses have various structures and types, one of which is an intermediate transfer type in which a color image is formed. The image forming apparatus of the intermediate transfer type is configured so that toner images of respective colors are transferred to an intermediate transfer belt (primary transfer), after which the corresponding toner images are transferred to recording paper again (secondary transfer), and the image is fixed to the recording paper by thermocompression. Since toner remains on the intermediate transfer belt after the toner images are transferred to the recording paper, there is a need to remove the remaining toner prior to the next image forming process. For this reason, the image forming apparatus is provided with a belt cleaning device for removing the toner remaining on the intermediate transfer belt.

Typical belt cleaning devices electrically adsorb the toner remaining on the intermediate transfer belt to a surface of a collection roller, and scrape off the toner with a cleaning blade. In this configuration, paper dust may become stuck in a contact portion between the collection roller and the cleaning blade, causing defects in cleaning on the collection roller and the intermediate transfer belt, and generating vertical black stripes on the image. Further, a technique for resolving a similar problem with a cleaning unit of a photoreceptor may include a technique for thrusting the cleaning blade in a direction of a rotating shaft of the photoreceptor to remove foreign materials such as paper dust.

SUMMARY

A belt cleaning device according to an aspect of the present disclosure includes a collection roller, a cleaning blade, a sealing member, a first thrust mechanism, and a second thrust mechanism.

The collection roller is rotated by a rotational driving force from a drive source, and electrically adsorbs and collects remaining toner on an intermediate transfer belt.

The cleaning blade extends along a rotating shaft of the collection roller, and a tip of which comes into contact with a surface of the collection roller under pressure and scrapes off the toner adsorbed to the surface of the collection roller rotated by the driving force from the drive source.

The sealing member extends along the rotating shaft of the collection roller, and a tip of which softly comes into contact with the surface of the collection roller and prevents counterflow of the toner scraped off by the cleaning blade.

The first thrust mechanism thrusts the collection roller in a direction of the rotating shaft of the collection roller by the rotational driving force transmitted to the collection roller.

The second thrust mechanism thrusts the cleaning blade in the direction of the rotating shaft of the collection roller in a thrust cycle shorter than that of the collection roller based on the first thrust mechanism by the rotational driving force transmitted to the collection roller.

A image forming apparatus according to another aspect of the present disclosure includes an intermediate transfer unit, and an image forming unit, and the belt cleaning device.

The intermediate transfer unit includes an intermediate transfer belt.

The image forming unit are disposed to face the intermediate transfer belt.

DETAILED DESCRIPTION

Figure 1:
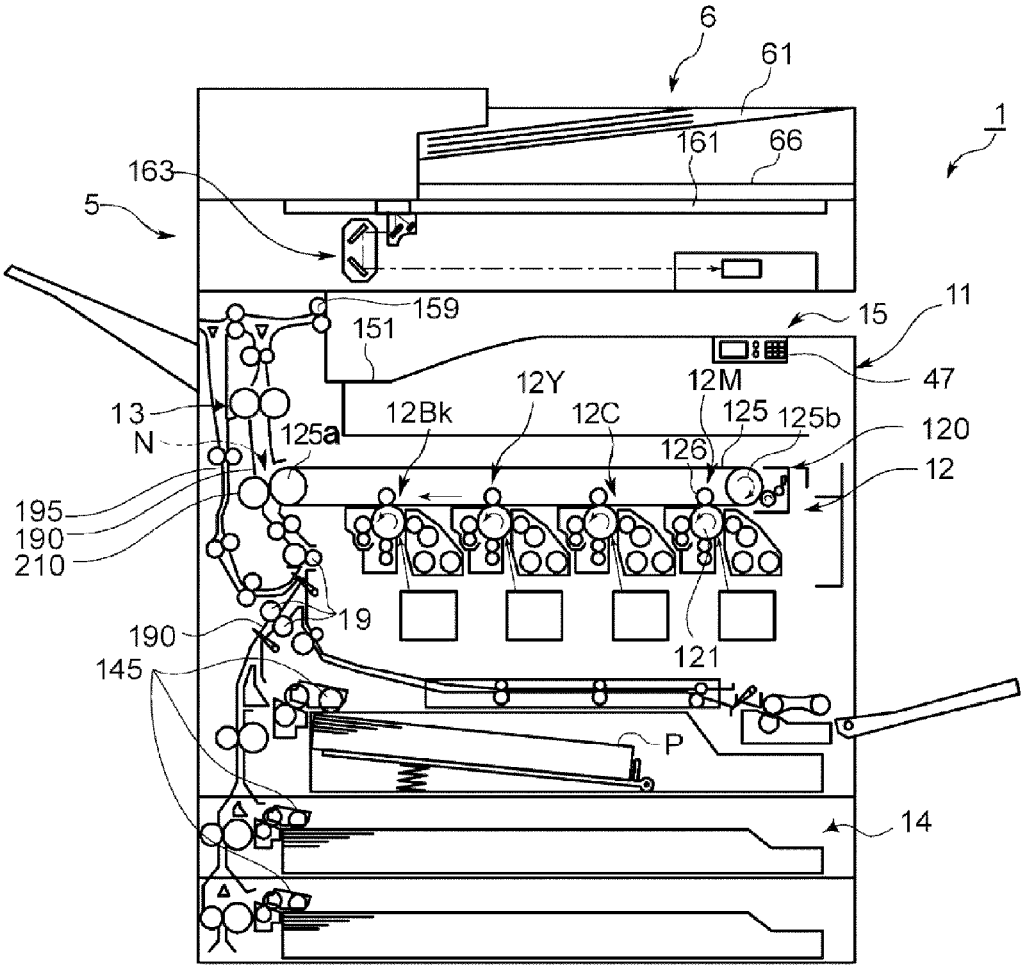
FIG. 1 is a front cross-sectional view showing a structure of an image forming apparatus according to an embodiment of the present disclosure.

Hereinafter, a belt cleaning device and an image forming apparatus according to an embodiment of the present disclosure will be described with reference to the drawings. FIG. 1 is a front cross-sectional view showing a structure of an image forming apparatus according to an embodiment of the present disclosure.

An image forming apparatus 1 according to an embodiment of the present disclosure is a multifunction device combining a plurality of functions such as a copy function, a printer function, a scanner function, and a facsimile function. The image forming apparatus 1 includes an apparatus main body 11 that is equipped with an operation unit 47, an image forming unit 12, a fixing unit 13, a paper feed unit 14, a document conveying unit 6, and an image reading unit 5.

The operation unit 47 receives instructions, such as an instruction to implement an image forming operation and an instruction to implement a document reading operation, from an operator with regard to various operations and processes which can be implemented by the image forming apparatus 1.

When the image forming apparatus 1 performs the document reading operation, the image reading unit 5 optically reads an image of a document fed by the document conveying unit 6 or a document placed on a document table glass 161 to generate image data. The image data generated by the image reading unit 5 is stored in an internal hard disk drive (HDD) or a networked computer.

When the image forming apparatus 1 performs the image forming operation, the image forming unit 12 forms toner images on recording paper P as a recording medium fed from the paper feed unit 14 based on the image data generated by the document reading operation, the image data received from the networked computer, or the image data stored in the internal HDD. Image forming units 12M, 12C, 12Y, and 12Bk of the image forming unit 12 are each equipped with a photosensitive drum, a developing device supplying toner to the photosensitive drum, a toner cartridge (not shown) containing the toner, a charging device, an exposure device, and a primary transfer roller 126.

When color printing is carried out, the image forming unit 12M for magenta, the image forming unit 12C for cyan, the image forming unit 12Y for yellow, and the image forming unit 12Bk for black of the image forming unit 12 form the toner images on the photosensitive drums 121 based on images composed of respective color components constituting the image data by charging, exposure, and developing processes, and cause the toner images to be transferred to an intermediate transfer belt 125 stretched on a driving roller 125*a* and a driven roller 125*b* by the primary transfer rollers 126.

The intermediate transfer belt 125 has an image carrying surface which is set to an outer circumferential surface thereof and to which the toner images are transferred, and is driven in contact with circumferential surfaces of the photosensitive drums 121 by the driving roller 125*a*. The intermediate transfer belt 125 endlessly runs between the driving roller 125*a* and the driven roller 125*b* while being synchronized with each photosensitive drum 121.

The toner images of the respective colors which are transferred to the intermediate transfer belt 125 are superimposed on the intermediate transfer belt 125 by adjusting transfer timing, thereby becoming a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N at which the intermediate transfer belt 125 is sandwiched between the secondary transfer roller 210 and the driving roller 125*a*. Afterwards, the fixing unit 13 causes the toner image on the recording paper P to be fixed to the recording paper P by thermocompression. The recording paper P on which the color image undergoing the fixing process is formed is ejected to an eject tray 151.

A portion of the intermediate transfer belt 125 which is stretched on the driven roller 125*b* is provided with a belt cleaning device 120. The belt cleaning device 120 collects toner remaining on the outer circumferential surface of the intermediate transfer belt 125.

Further, in addition to the belt cleaning device 120, the intermediate transfer belt 125, the primary transfer roller 126, the driving roller 125*a*, and the driven roller 125*b* are mounted on an intermediate transfer unit 50.

Figure 2A:
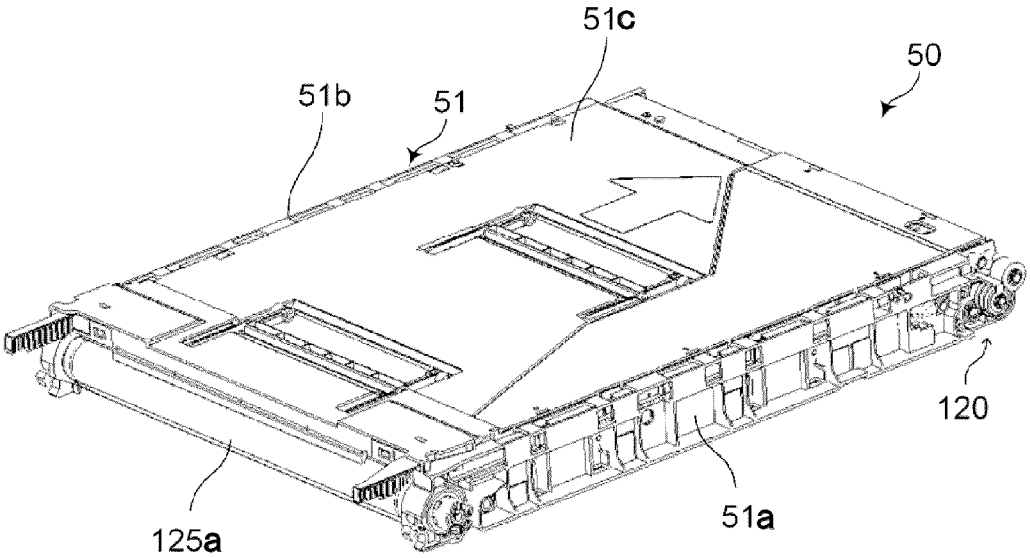
FIG. 2A is a perspective view showing an appearance of the intermediate transfer unit when viewed from above.
Figure 2B:
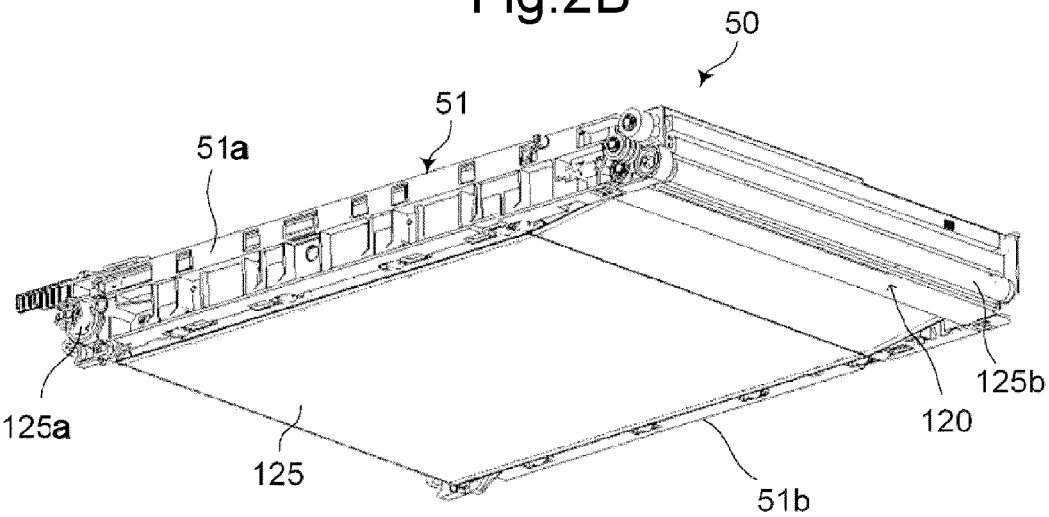
FIG. 2B is a perspective view showing an appearance of the intermediate transfer unit when viewed from below.

Next, the intermediate transfer unit 50 will be described. FIG. 2A is a perspective view showing an appearance of the intermediate transfer unit 50 when viewed from above, and FIG. 2B is a perspective view showing an appearance of the intermediate transfer unit 50 when viewed from below.

The intermediate transfer unit 50 is mounted above the image forming unit 12 in the apparatus main body 11. As shown in FIG. 2A, the intermediate transfer belt 125, the primary transfer roller 126, the driving roller 125*a*, the driven roller 125*b*, and the belt cleaning device 120 are mounted on the intermediate transfer unit 50 as described above.

The intermediate transfer unit 50 is equipped with a casing 51. Each mechanism with which the intermediate transfer unit 50 is equipped is mounted in the casing 51. The casing 51 is made up of an upper surface portion 51*c* and lateral surface portions 51*a* and 51*b* provided for edges of the upper surface portion 51*c*. The driving roller 125*a* is rotatably supported on one end of the casing 51, and the driven roller 125*b* is supported on the other end of the casing 51.

In the state in which the intermediate transfer belt 125 is stretched between the driving roller 125*a* and the driven roller 125*b* supported in this way, an upper part and both lateral parts of the intermediate transfer belt 125 are covered by the casing 51 made up of the upper surface portion 51*c* and the lateral surface portions 51*a* and 51*b*. As shown in FIG. 2B, a lower portion of the intermediate transfer belt 125 is kept exposed from the casing 51. In the state in which the intermediate transfer unit 50 is mounted in the apparatus main body 11, the image forming units for respective colors are arranged in the apparatus main body 11 below the portion of the exposed intermediate transfer belt 125.

Figure 3:
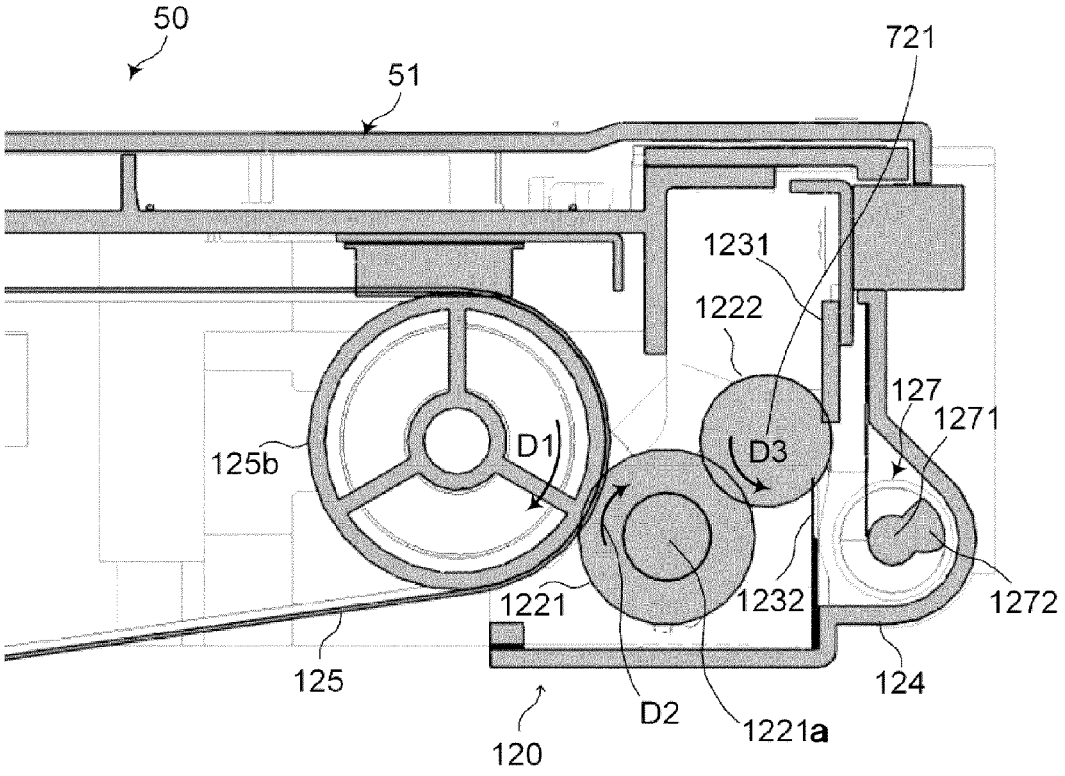
FIG. 3 is a partial cross-sectional view showing surroundings of an intermediate transfer cleaning unit in the intermediate transfer unit.
Figure 4A:
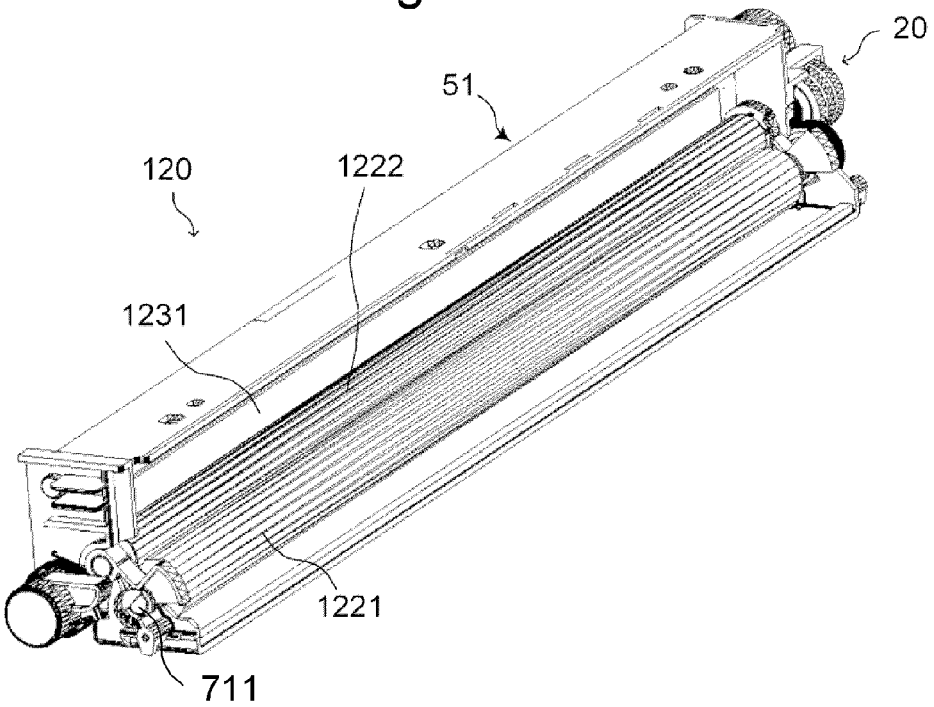
FIG. 4A is a perspective view of the belt cleaning device.
Figure 4B:
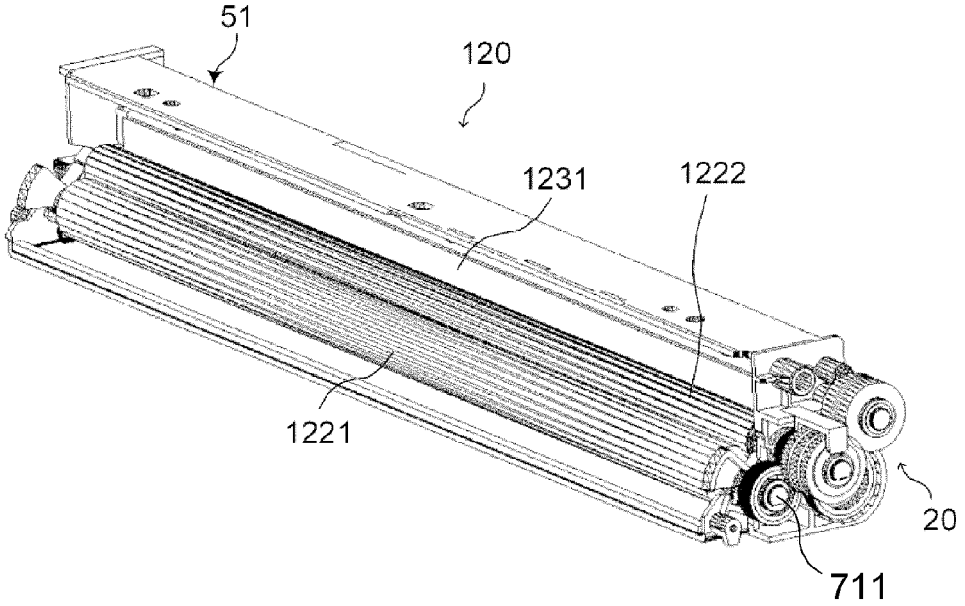
FIG. 4B is a perspective view of the belt cleaning device when viewed from an angle different from that of FIG. 4A.

Next, an internal constitution of the intermediate transfer unit 50 will be described. FIG. 3 is a side cross-sectional view showing surroundings of the driven roller 125*b* and the belt cleaning device 120 in the intermediate transfer unit 50. FIG. 4A is a perspective view of the belt cleaning device 120, and FIG. 4B is a perspective view of the belt cleaning device 120 when viewed from an angle different from that of FIG. 4A.

A tension roller applying tension to the intermediate transfer belt 125, the primary transfer rollers 126 of respective colors (FIG. 1), and the belt cleaning device 120 are installed in the casing 51 of the intermediate transfer unit 50, in addition to the intermediate transfer belt 125, the driving roller 125*a*, and the driven roller 125*b* described above.

The belt cleaning device 120 according to the embodiment of the present disclosure comes into contact with the portion of the outer circumferential surface of the intermediate transfer belt 125 that is kept stretched on the driven roller 125*b*, and electrically adsorbs and collects the toner remaining on the outer circumferential surface.

The belt cleaning device 120 has a brush roller 1221, a collection roller 1222, a sealing member 1232, a cleaning blade 1231, a toner reservoir 124, and a toner conveying screw 127.

The brush roller 1221 comes into contact with the outer circumferential surface of the intermediate transfer belt 125 stretched on the driven roller 125*b*, and collects the toner remaining on the outer circumferential surface using electric adsorption. The brush roller 1221 is formed by winding an unwoven fabric formed of, for instance, a resinous filament around the entire circumference of a rotating shaft 711 thereof. The rotating shaft 711 of the brush roller 1221 extends in a direction of a rotating shaft of the driven roller 125*b*, and is rotatably supported on the casing 51. The brush roller 1221 is rotated around a rotating shaft 1221*a* in a direction (i.e. a direction of an arrow D2 shown in FIG. 3) that is opposite to a rotational direction of the driven roller 125*b* (i.e. a direction of an arrow D1 shown in FIG. 3).

The collection roller 1222 is made of, for instance, a metal, comes into contact with a surface of the brush roller 1221, and electrically collects the toner that the brush roller 1221 has collected from the brush roller 1221. A rotating shaft 721 of the collection roller 1222 extends in the direction of the rotating shaft of the brush roller 1221, and is rotatably supported on the casing 51. The collection roller 1222 is rotated around the rotating shaft 721 in the same direction (i.e. a direction of an arrow D3 shown in FIG. 3) as the rotational direction of the brush roller 1221.

The sealing member 1232 is made of a flexible material such as urethane, and is fixed and attached to the toner reservoir 124. The sealing member 1232 is installed so that a top thereof is softly in contact with a surface of the collection roller 1222. The sealing member 1232 is set to very weakly bring a top end thereof into contact with the surface of the collection roller 1222, compared to the cleaning blade 1231. The toner that is scraped off from the surface of the collection roller 1222 by the cleaning blade 1231, is prevented from flowing back to the side of the brush roller 1221 at a contact position at which the top of the sealing member 1232 and the surface of the collection roller 1222 are in contact with each other while allowing passage of the toner sticking to the surface of the collection roller 1222.

The cleaning blade 1231 is formed of a tabular member, and extends in the direction of the rotating shaft of the collection roller 1222. The cleaning blade 1231 is mounted on the casing 51 so that, when viewed from the side shown in FIG. 3, a tip thereof is in contact with the surface of the collection roller 1222. The cleaning blade 1231 scrapes off the toner which the collection roller 1222 has collected from the surface of the collection roller 1222. The scraped off toner falls and accumulates in the toner reservoir 124.

The toner reservoir 124 is provided with a toner conveying screw 127. The toner conveying screw 127 extends in the direction of the rotating shaft of the collection roller 1222, and its rotating shaft 1271 is rotatably supported on the casing 51. A toner conveying blade 1272 is installed on a circumferential surface of the rotating shaft 1271 of the toner conveying screw 127 in a spiral shape. The toner in the toner reservoir 124 is gathered in a waste toner tank (not shown) disposed at a predetermined position in a direction of the rotating shaft 1271 by the toner conveying blade 1272. Thereby, the remaining toner on the outer circumferential surface of the intermediate transfer belt 125 is collected.

The belt cleaning device 120 is provided with a thrust mechanism 20.

Figure 5A:
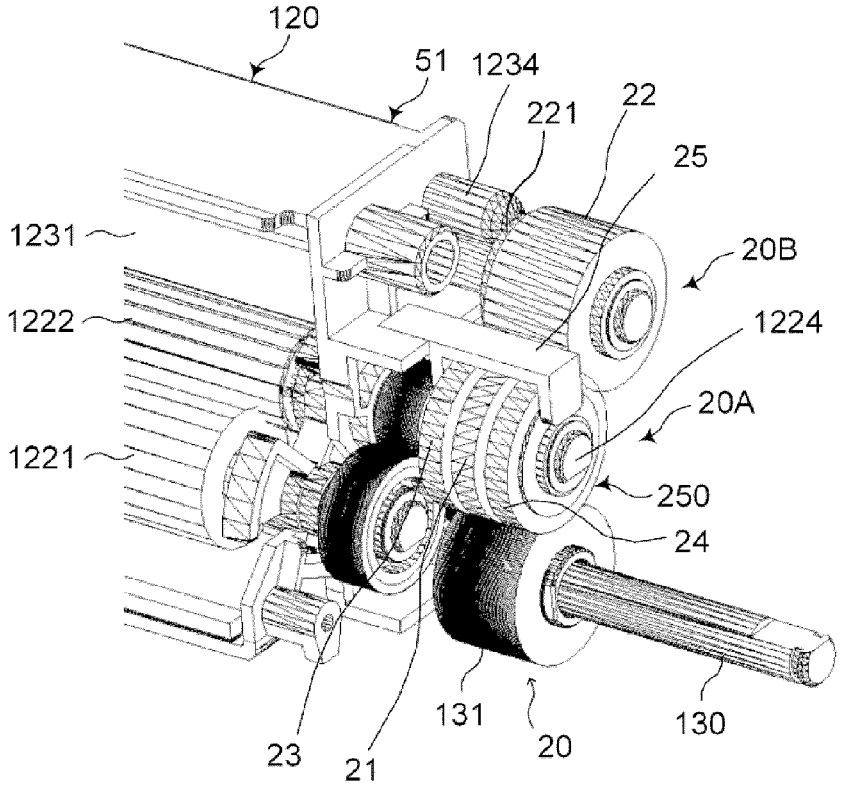
FIG. 5A is a perspective view showing surroundings of the thrust mechanism of the belt cleaning device.
Figure 5B:
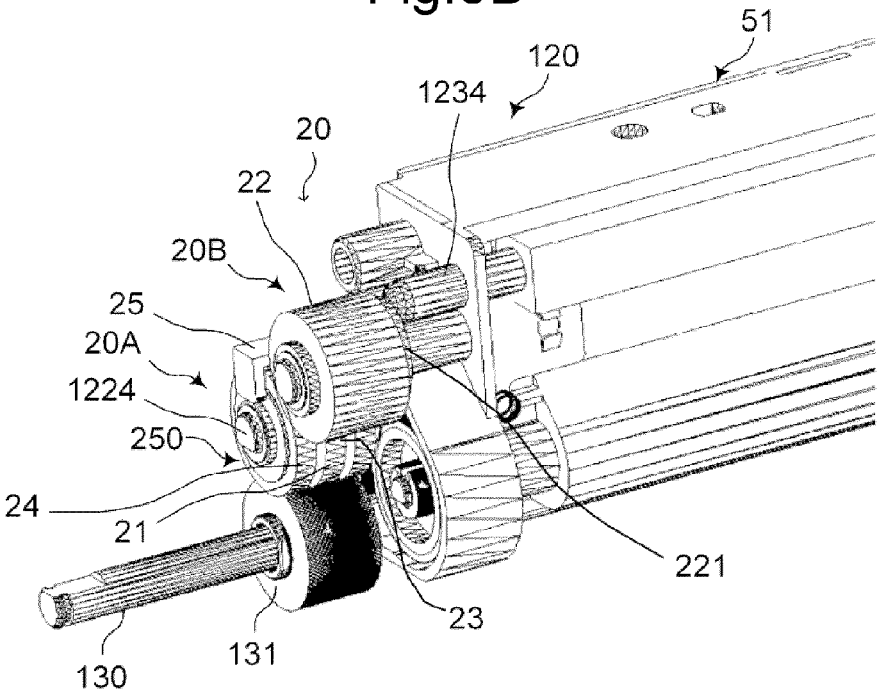
FIG. 5B is a perspective view showing a state in which the surroundings of the thrust mechanism of the belt cleaning device are viewed from an angle different from FIG. 5A.
Figure 6:
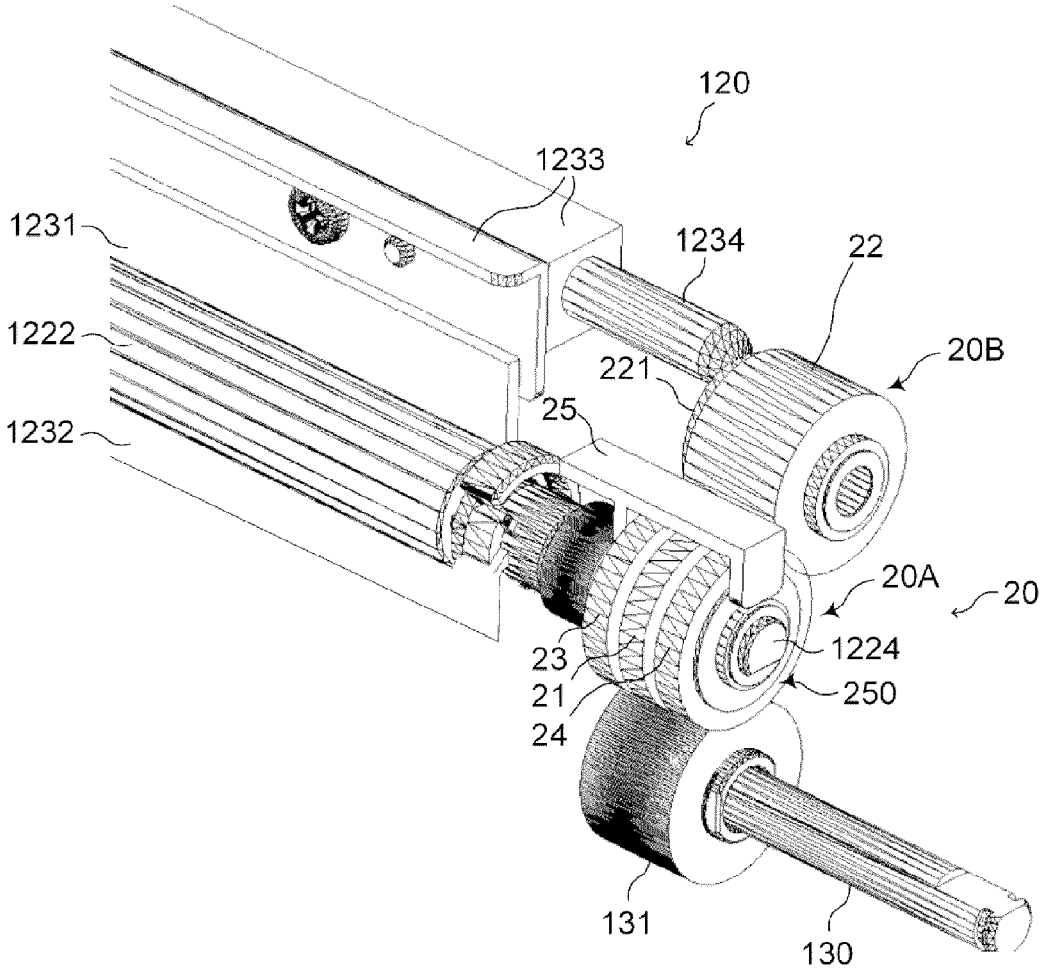
FIG. 6 is a partial perspective view showing the intermediate transfer cleaning unit.
Figure 7:
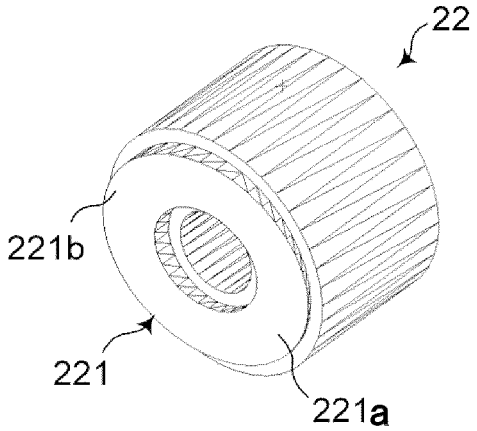
FIG. 7 is a perspective view showing a thrust cam gear thrusting a cleaning blade.
Figure 8:
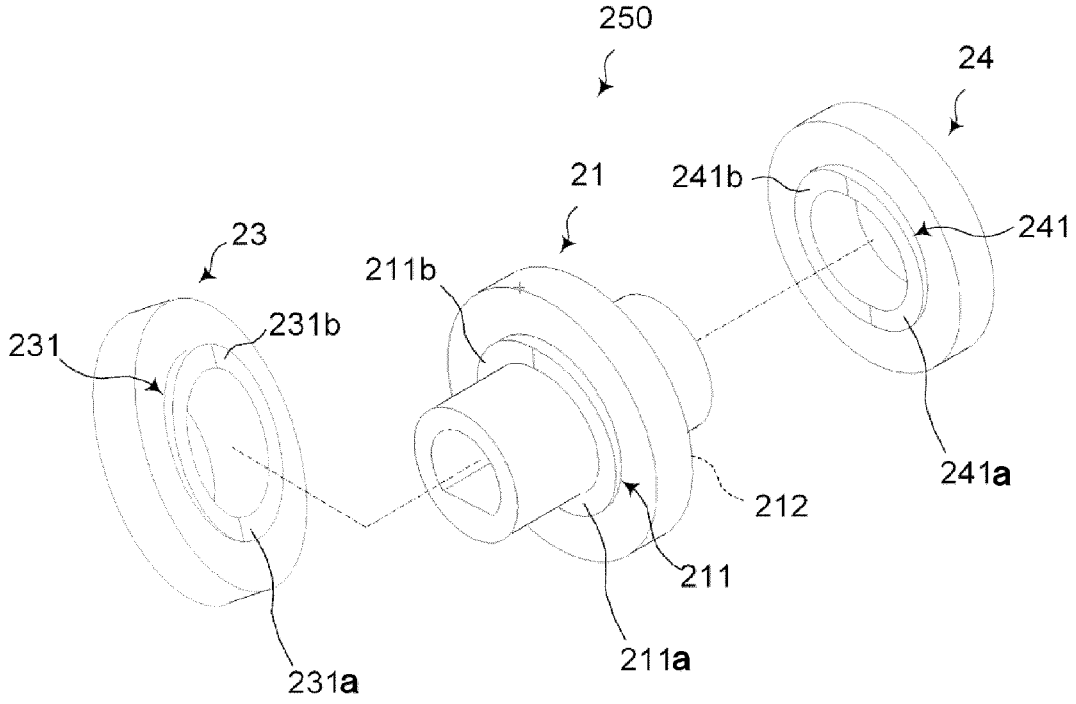
FIG. 8 is a perspective view showing a group of thrust cam gears thrusting a collection roller.
Figure 9:
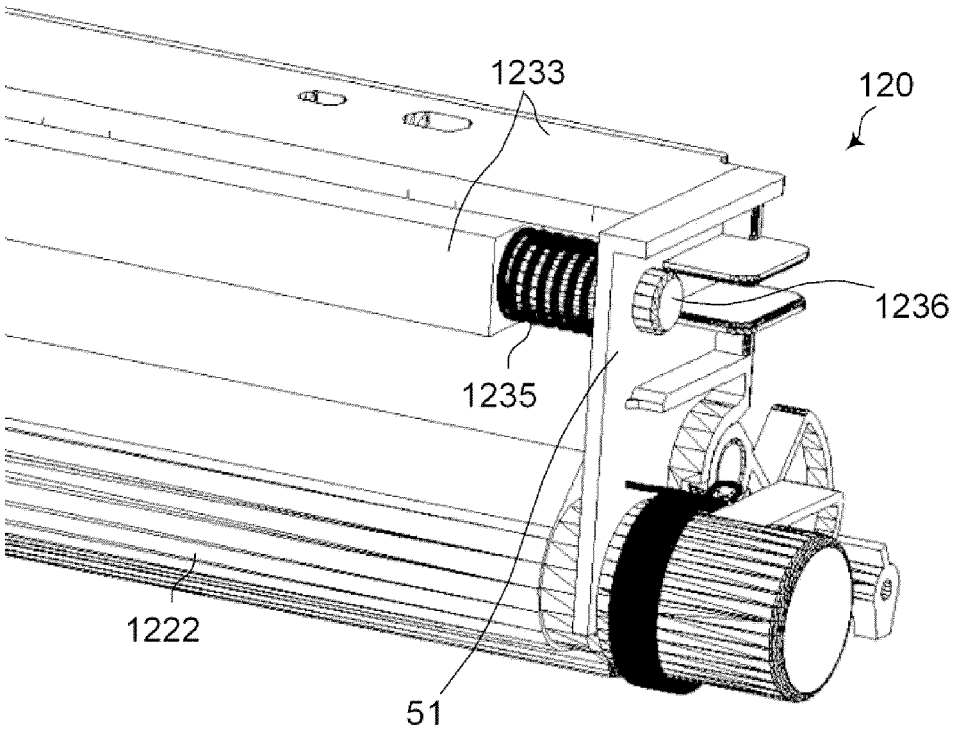
FIG. 9 is a partial perspective view showing the intermediate transfer cleaning unit at a separate angle.

Next, the thrust mechanism provided for the belt cleaning device 120 will be described. FIG. 5A is a perspective view showing surroundings of the thrust mechanism of the belt cleaning device 120, and FIG. 5B is a perspective view showing a state in which the surroundings of the thrust mechanism of the belt cleaning device 120 are viewed from an angle different from FIG. 5A. FIG. 6 is a perspective view selectively showing the belt cleaning device 120 and main portions of the thrust mechanism. FIG. 7 is a perspective view of a thrust cam gear. FIG. 8 is an exploded perspective view showing a first gear and each thrust adjusting gear of a first thrust mechanism. FIG. 9 is a perspective view showing an end of the belt cleaning device 120 which becomes a side at which the thrust mechanism is not provided.

The belt cleaning device 120 includes the thrust mechanism 20 that independently thrusts the cleaning blade 1231 and the collection roller 1222 in a rotating shaft direction of the collection roller 1222. The thrust mechanism 20 is equipped with a first thrust mechanism 20A and a second thrust mechanism 20B.

The first thrust mechanism 20A is a mechanism that thrusts the collection roller 1222 in an extending direction of a rotating shaft 1224 of the collection roller 1222 (i.e. a rotating shaft direction).

The second thrust mechanism 20B is a mechanism that thrusts the cleaning blade 1231 in the rotating shaft direction of the collection roller 1222 in a thrust cycle shorter than that of the collection roller 1222 caused by the first thrust mechanism 20A.

The first thrust mechanism 20A will be described. The first thrust mechanism 20A is equipped with a first thrust cam gear 250. The first thrust cam gear 250 has a plurality of gears to be described below, and thrusts the collection roller 1222 in a predetermined thrust cycle. The first thrust cam gear 250 is rotated by a driving force from a drive source that is, for instance, a motor supplying a driving force to each drive train of the belt cleaning device 120.

The first thrust mechanism 20A is equipped with a gear guide 25 in addition to the first thrust cam gear 250. The first thrust cam gear 250 is equipped with a first gear 21 and thrust adjusting gears 23 and 24.

The first gear 21 has a predetermined number of teeth, and is mounted on the rotating shaft 1224 of the collection roller 1222. The first gear 21 is engaged with a driving gear 131 that integrally corotates with a rotating shaft 130 of the drive source, and is integrally rotated along with the rotating shaft 1224 by the driving force from the drive source, thereby rotating the collection roller 1222. As shown in FIG. 8, one side of the first gear 21 which is located in the rotating shaft direction is formed with a cam follower 211 sliding on a cam 231 (to be described below) formed on the thrust adjusting gear 23, and the other side of the first gear 21 is formed with a cam follower 212 sliding on a cam 241 (to be described below) formed on the thrust adjusting gear 24.

The cam follower 211 is shaped of an arc having a lowermost part 211*a* and an uppermost part 211*b* that is formed by connecting to the lowermost part 211*a* and is formed at a position shifted from the lowermost part 211*a* in a rotational direction of the cam follower 211 by a half circumference. Thus, when the cam follower 211 makes one rotation along with the first gear 21, a height of the cam follower 211 varies from the lowest value to the highest value, and returns to the lowest value again after the variation to the highest value. The cam follower 212 is configured similarly to the cam follower 211. However, with regard to a rotational direction position of the first gear 21, a portion at which the height of the cam follower 212 has the highest value is located on the rear of the first gear 21 with respect to a portion at which the height of the cam follower 211 has the lowest value. To this end, the uppermost and lowermost parts of the cam followers 211 and 212 are set to reciprocal heights.

The thrust adjusting gears 23 and 24 are mounted in a state in which they are loosely fitted around the rotating shaft 1224 of the collection roller 1222. The thrust adjusting gear 23 is arranged on a side of the first gear 21 which is a side of the collection roller 1222. The thrust adjusting gear 24 is disposed on the other side of the first gear 21 which is the opposite side of the side on which the thrust adjusting gear 23 is arranged.

Further, the thrust adjusting gears 23 and 24 have a predetermined number of teeth that is different from the number of teeth of the first gear 21. The thrust adjusting gears 23 and 24 are engaged with the driving gear 131 of the drive source, and are rotated independently of the rotating shaft 1224 by the driving force from the drive source. In other words, the thrust adjusting gears 23 and 24 run idle relative to the rotating shaft 1224.

As shown in FIG. 8, a side of the thrust adjusting gear 23 which is a side facing the first gear 21 is provided with a cam 231 that slides in contact with the cam follower 211 of the first gear 21. The cam 231 has, for instance, a shape similar to that of the cam follower 211, and is shaped in an arc having a lowermost part 231*a* and an uppermost part 231*b* that is formed by connecting to the lowermost part 231*a* and is formed at a position shifted from the lowermost part 231*a* in a rotational direction of the thrust adjusting gear 23 by a half circumference.

A side of the thrust adjusting gear 24 which is a side facing the first gear 21 is provided with a cam 241 that has, for instance, a shape similar to that of the cam 231 and has a lowermost part 241*a* and an uppermost part 241*b*.

As shown in FIGS. 5A and 6, the gear guide 25 supports the thrust adjusting gears 23 and 24 with the thrust adjusting gears 23 and 24 sandwiched from both sides in the rotating shaft direction, and restricts the thrust adjusting gears 23 and 24 to move in the rotating shaft direction of the collection roller 1222. In other words, the gear guide 25 fixes positions at which the thrust adjusting gears 23 and 24 are arranged in the rotating shaft direction of the collection roller 1222.

As the first gear 21 slides in contact with the cam follower, the cams 231 and 241 of the respective thrust adjusting gears 23 and 24 shift the first gear 21 between the thrust adjusting gears 23 and 24 in the rotating shaft direction of the collection roller 1222. Detailed movements of the cam and the cam follower will be described below.

The second thrust mechanism 20B will be described. The second thrust mechanism 20B is equipped with a cam follower 1234 attached to one end of the cleaning blade 1231, and a cam gear (second thrust cam gear) 22.

The cam follower 1234 extends from one end of the cleaning blade 1231 toward the cam gear 22, and is configured so that a tip thereof is in contact with the cam 221 provided for a side of the cam gear.

The cleaning blade 1231 is mounted on the casing 51 so as to freely move in the rotating shaft direction of the collection roller 1222. As shown in FIG. 9, in a longitudinal direction of the cleaning blade holder 1233 holding the cleaning blade 1231, a compression spring 1235 is mounted on the other end of the cleaning blade 1231 which is opposite to the side at which the belt cleaning device 120 is arranged. An end of the cleaning blade holder 1233 is provided with a support shaft 1236 that causes the cleaning blade holder 1233 and the cleaning blade 1231 held thereto to be supported on the casing 51. The compression spring 1235 is mounted on the support shaft 1236 in such a manner that one end thereof is mounted on the cleaning blade holder 1233 and that the other end thereof is mounted on the casing 51. Thereby, the compression spring 1235 biases the cleaning blade holder 1233 in a direction in which the cam follower 1234 presses the cam 221 of the cam gear 22 to be described below.

The cam gear 22 is rotatably supported on the casing 51, and is engaged with the first gear 21 of the first thrust mechanism 20A, thereby being rotated by the driving force from the drive source. As shown in FIG. 7, the cam 221 is formed on a face of the cam gear 22 which faces the cam follower 1234. The cam 221 comes into contact with the cam follower 1234, changes a push-in amount of the cleaning blade 1231 in the rotating shaft direction of the collection roller 1222, and thrusts the cleaning blade 1231 in a predetermined thrust cycle. Similar to each of the cams 231 and 241 of the thrust adjusting gears 23 and 24, the cam 221 is shaped in an arc having a lowermost part 221*a* and an uppermost part 221*b* that is formed by connecting to the lowermost part 221*a* and is formed at a position shifted from the lowermost part 221*a* in a rotational direction of the cam gear 22 by a half circumference. However, a height of the cam 221 from the lowermost part 221*a* to the uppermost part 221*b*, i.e., an amount of movement when the cleaning blade 1231 is thrust in its longitudinal direction by the cam 221, is appropriately determined as a value suitable for removal of paper dust at a contact portion of the cleaning blade 1231 which comes into contact with the surface of the collection roller 1222. In the present embodiment, the thrust cycle in which the cam 221 thrusts the cleaning blade 1231 when the cam gear 22 makes one rotation is shorter than that in which the first thrust mechanism 20A thrusts the collection roller 1222 when the first gear 21 makes one rotation.

Figure 10:
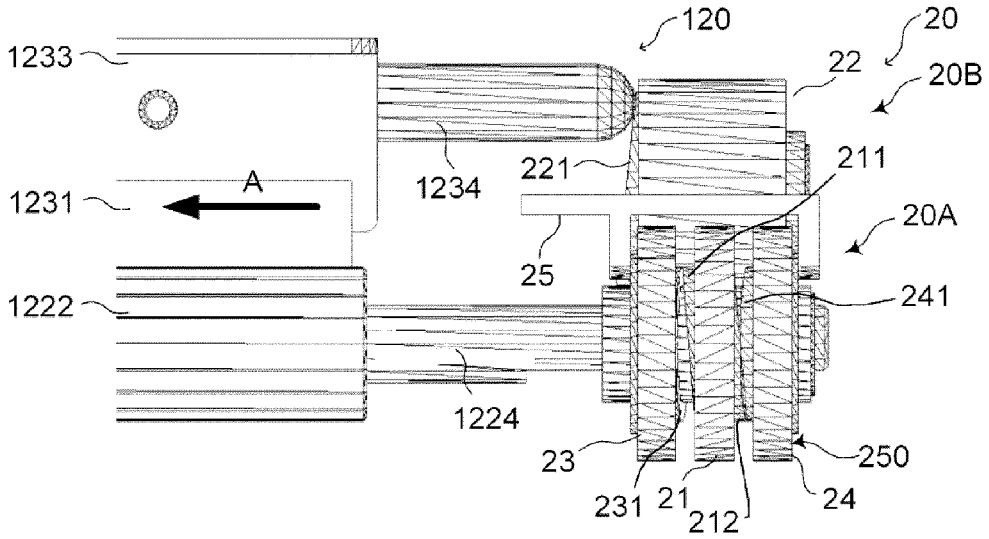
FIG. 10 is a view for describing a thrusting operation of the cleaning blade.
Figure 11:
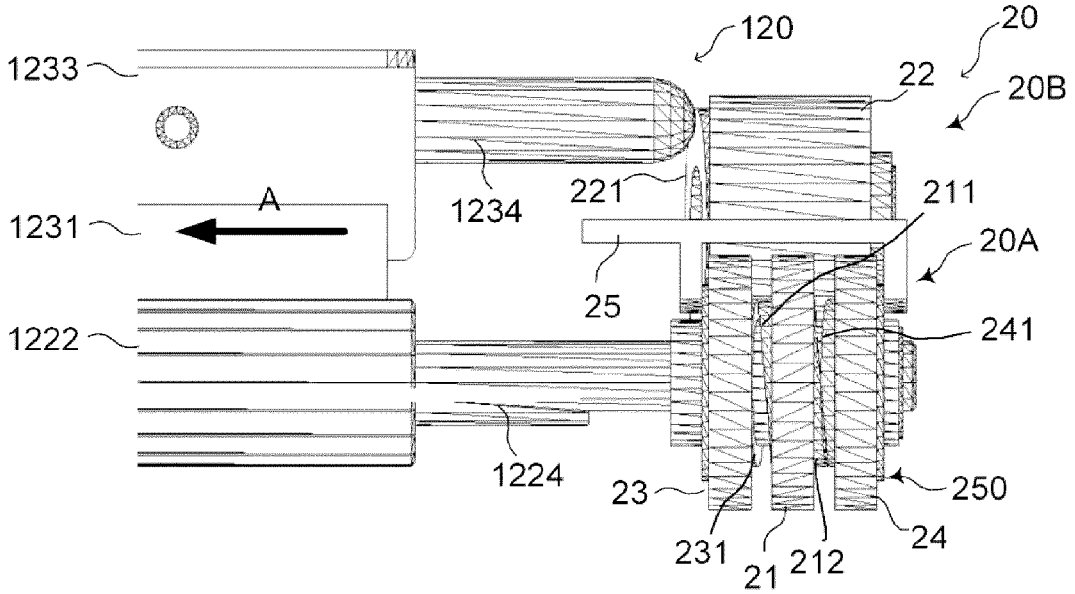
FIG. 11 is a view for describing a thrusting operation of the cleaning blade.
Figure 12:
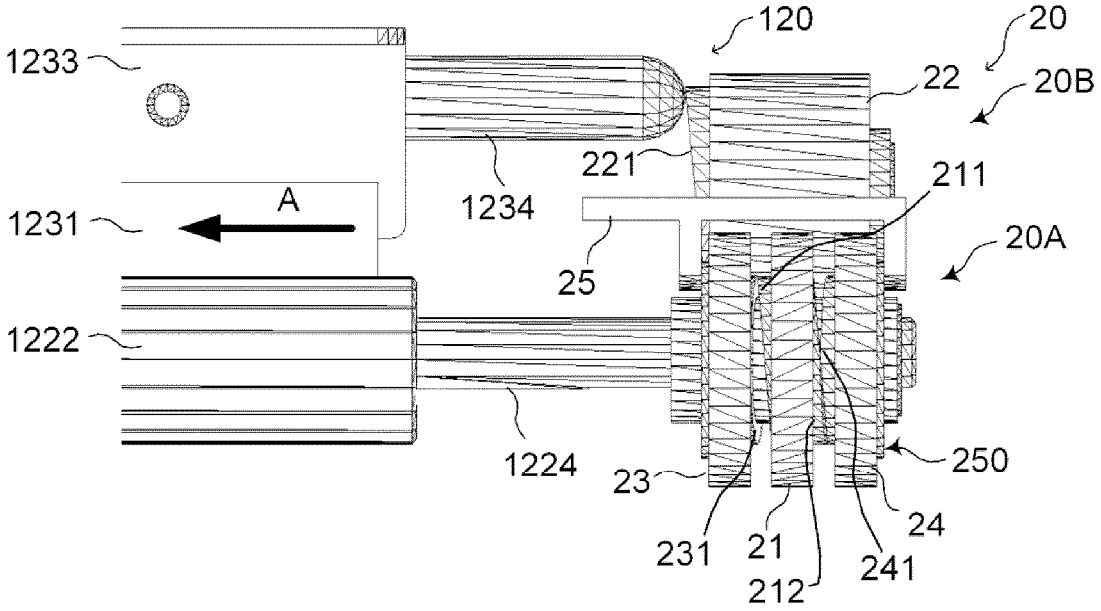
FIG. 12 is a view for describing a thrusting operation of the cleaning blade.

Next, a thrusting operation of the cleaning blade 1231 based on the thrust mechanism 20 having the aforementioned constitution will be described. FIGS. 10 to 12 are views for describing a thrusting operation of the cleaning blade 1231.

The cam 221 is displaced by rotation of the cam gear 22, and the cam follower 1234 sliding in contact with the cam 221 performs an operation following the displacement of the cam 221. Thereby, the cleaning blade 1231 performs a thrusting operation. As shown in FIG. 10, when the cam follower 1234 comes into contact with the lowermost part 221*a*, and the displacement of the cam 221 of the cam gear 22 is in a state of the minimum value, the cleaning blade 1231 is located at the rightmost end in the longitudinal direction thereof, i.e., in the rotating shaft direction of the collection roller 1222.

When the driving gear 131 of the drive source is rotated from here, the first gear 21 engaged with the driving gear 131 is rotated, and the collection roller 1222 initiates thrust movement in its rotating shaft direction. Then, due to rotation of the cam gear 22 engaged with the first gear 21, as shown in FIG. 11, depending on an amount of the rotation of the cam gear 22, an amount of displacement of the cam 221 is changed to gradually increase in a direction of an arrow A. The cleaning blade 1231 is thrust in the direction of the arrow A by a distance corresponding to the displacement of the cam 221.

When the cam gear 22 is further rotated from the state shown in FIG. 11, the cam follower 1234 comes into contact with the uppermost part 221*b* as shown in FIG. 12, and the amount of displacement of the cam 221 becomes the maximum value. Then, the cleaning blade 1231 moves to the leftmost position in the direction of the arrow A.

Further, when the cam gear 22 is further rotated from the state shown in FIG. 12, the amount of displacement of the cam 221 turns into a decrease, and the result returns to the state shown in FIG. 10, i.e., the state in which the amount of displacement of the cam 221 becomes the minimum value. In other words, in the present embodiment, when the cam gear 22 makes one rotation from the state shown in FIG. 10, the cleaning blade 1231 performs the thrust movement reciprocating between the position of the rightmost end shown in FIG. 10 and the position of the leftmost end shown in FIG. 12. In this way, the cleaning blade 1231 performs the thrusting operation in the same cycle as the rotation cycle of the cam gear 22. According to the rotation of the cam gear 22, the states shown in FIGS. 10 to 12 are repeated.

Since the cleaning blade 1231 comes into contact with the collection roller 1222 under strong pressure in order to scrape off the toner stuck to the surface of the collection roller 1222, an effect of removing foreign materials is low if the cleaning blade 1231 is not thrust relatively rapidly. Therefore, for example, the first gear 21 and the cam gear 22 are adapted to have the same number of teeth. In this case, whenever the collection roller 1222 makes one rotation, the cleaning blade 1231 is reciprocated once by the thrust movement. In other words, the rotation cycle of the collection roller 1222 and the thrust cycle of the cleaning blade 1231 are made identical. Thereby, the cleaning blade 1231 is relatively rapidly thrust on the surface of the collection roller 1222 in its rotating shaft direction, and the foreign materials stuck to the contact portion of the cleaning blade 1231 and the collection roller 1222 are kept removed. However, the thrust cycle of the cleaning blade 1231 is not limited to the foregoing, and may be appropriately changed.

Figure 13:
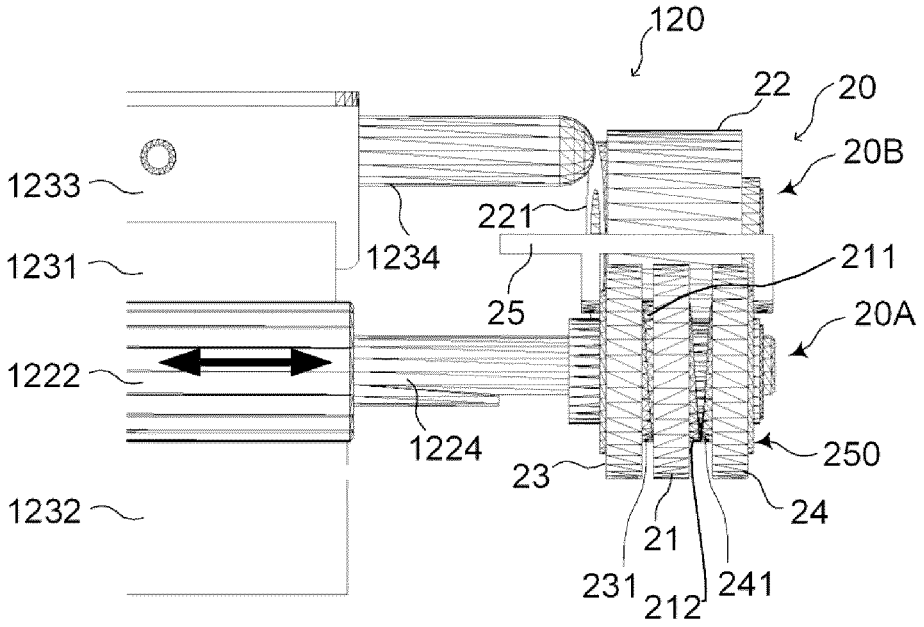
FIG. 13 is a view for describing a thrusting operation of the collection roller.
Figure 14:
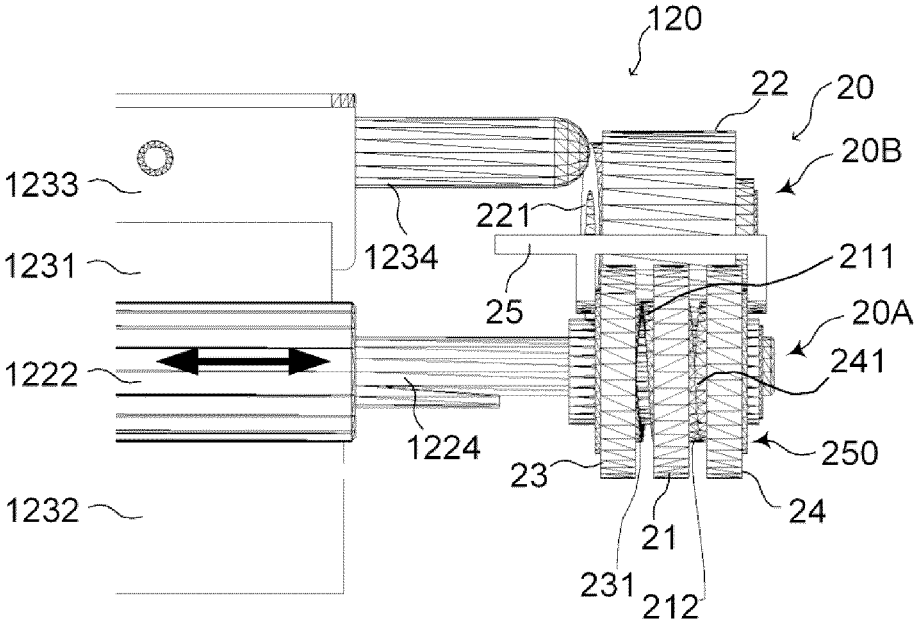
FIG. 14 is a view for describing a thrusting operation of the collection roller.
Figure 15:
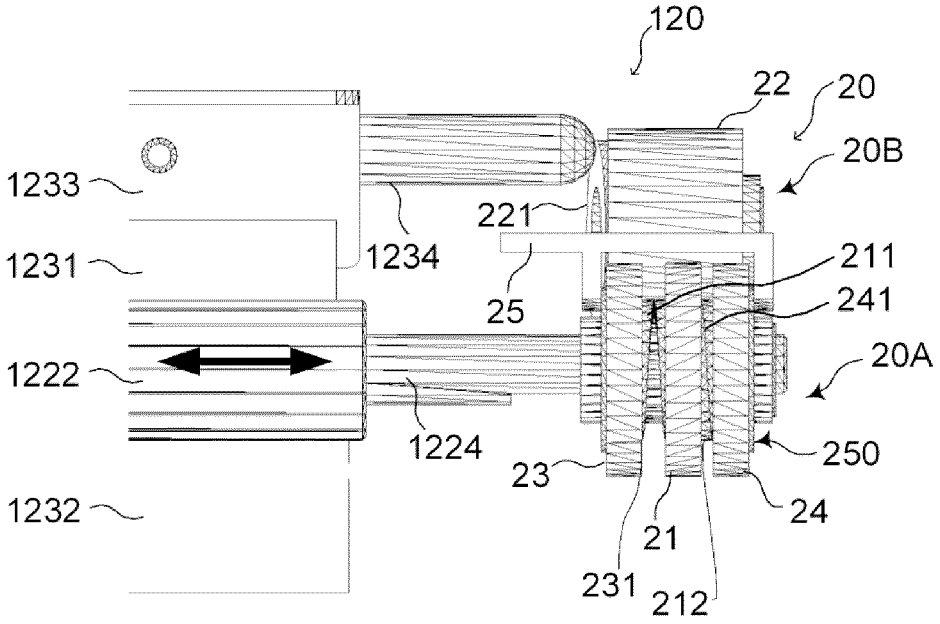
FIG. 15 is a view for describing a thrusting operation of the collection roller.

Next, a thrusting operation of the collection roller 1222 will be described. FIGS. 13 to 15 are views for describing a thrusting operation of the collection roller 1222.

Here, in the present embodiment, an example in which the number of teeth of the first gear 21 is 20, and the number of teeth of each of the thrust adjusting gears 23 and 24 is 19 is shown.

When the first gear 21 is engaged with the rotated driving gear 131 and is thereby rotated by receiving the driving force of the drive source, the collection roller 1222 is rotated along with its rotating shaft 1224 in the first thrust mechanism 20A, as described above. In this case, the thrust adjusting gears 23 and 24 engaged with the driving gear 131 are also rotated at the same time. When the cams 231 and 241 are displaced with the rotation of the thrust adjusting gears 23 and 24, the first gear 21, the rotating shaft 1224, and the collection roller 1222 are thrust in the rotating shaft direction by an amount of movement of the cam followers 211 and 212 of the first gear 21 which slide on the cams 231 and 241 in contact with the cams 231 and 241.

For example, as shown in FIG. 13, the uppermost part of the cam follower 211 of the first gear 21 and the lowermost part of the cam 231 of the thrust adjusting gear 23 are adapted to be in contact with each other, and the uppermost part of the cam follower 211 of the first gear 21 and the uppermost part of the cam 241 of the thrust adjusting gear 24 are adapted to be in contact with each other. In this case, the first gear 21 is shifted to a position of the leftmost end in a direction of an arrow shown in FIG. 13.

When the first gear 21 and the thrust adjusting gears 23 and 24 are rotated with the rotation of the driving gear 131 from the state shown in FIG. 13, since the number of teeth of the first gear 21 is 20, and the number of teeth of each of the thrust adjusting gears 23 and 24 is 19, a contact state of the cam follower 211 of the first gear 21 and the cam 231 of the thrust adjusting gear 23 and a contact state of the cam follower 212 of the first gear 21 and the cam 241 of the thrust adjusting gear 24 are not maintained by a difference between an amount of rotation of the first gear 21 and an amount of rotation of each of the thrust adjusting gears 23 and 24, and a place at which the cam follower 211 comes into contact with the cam 231 and a place at which the cam follower 212 comes into contact with the cam 241 are changed depending on the rotation amounts of the first gear 21 and the thrust adjusting gears 23 and 24. For this reason, the contact state of the cam follower 211 of the first gear 21 and the cam 231 of the thrust adjusting gear 23 and the contact state of the cam follower 212 of the first gear 21 and the cam 241 of the thrust adjusting gear 24 are changed to, for instance, the state shown in FIG. 14, and the first gear 21 is shifted to the right side farther than the position of the leftmost end shown in FIG. 13.

When the first gear 21 and the thrust adjusting gears 23 and 24 are further rotated with the rotation of the driving gear 131 from the state shown in FIG. 14, the uppermost part 211*b* of the cam follower 211 of the first gear 21 and the uppermost part 231*b* of the cam 231 of the thrust adjusting gear 23 come into contact with each other, and the lowermost part of the cam follower 212 of the first gear 21 and the uppermost part of the cam 241 of the thrust adjusting gear 24 come into contact with each other as shown in FIG. 15, the first gear 21 is shifted to a position of the rightmost end.

For this reason, when the first gear 21 and the thrust adjusting gears 23 and 24 are rotated with the rotation of the driving gear 131, the first gear 21 performs thrust movement reciprocating between the position of the leftmost end and the position of the rightmost end between the respective arranged positions of the thrust adjusting gears 23 and 24 in an extending direction of the rotating shaft 1224. In this case, the thrust movement of the first gear 21 is guided by mechanical contact of the cams 231,241 and the cam followers 211,212. As such, the first gear 21, the rotating shaft 1224, and the collection roller 1222 can be thrust with the amounts of movement accurately corresponding to amounts of displacement of the cam followers 211 and 212 and amounts of displacement of the cams 231 and 241.

Further, when the first gear 21 and the thrust adjusting gears 23 and 24 are rotated with the rotation of the driving gear 131 in this way, the cam gear 22 engaged with the first gear 21 is also rotated. As such, the cleaning blade 1231 also performs the thrust movement shown in FIGS. 13 to 15.

The sealing member 1232 is formed of, for instance, a very thin urethane sheet having a thickness of about t0.1 to t0.2, and comes into contact with the surface of the collection roller 1222. As such, the thrust cycle of the collection roller 1222 is short like the aforementioned cleaning blade 1231, and an excess load is applied to the sealing member 1232. As a result, deflection takes place at the sealing member 1232, and a gap is generated between the collection roller 1222 and the sealing member 1232. There is a possibility of toner falling through the gap. Accordingly, it is necessary for the collection roller 1222 to be thrust at a relatively slow speed to the extent that no load is given so as to act as the sealing member 1232.

In the present embodiment, as described above, since the number of teeth of the first gear 21 is 20, and the number of teeth of each of the thrust adjusting gears 23 and 24 is set to be one less at 19, whenever the first gear 21 is rotated 20 times, the collection roller 1222 performs the thrust movement reciprocated once in its rotating shaft direction. In other words, the collection roller 1222 is thrust in a cycle 20 times to its own rotation cycle. In this case, for example, if the number of teeth of the cam gear 22 is set equal to that of the first gear 21 at 20, the cleaning blade 1231 can be thrust in a short cycle that is 1/20 of the thrust cycle of the collection roller 1222. The numbers of teeth of the first gear 21 and the thrust adjusting gears 23 and 24 shown herein is merely one example. The thrust cycle of the collection roller 1222 can be adjusted by changing each of the numbers of teeth.

Thus, (1) without applying an excessively great load to the sealing member 1232 by thrusting the collection roller 1222 at a relatively slow speed, it is possible to clean the foreign materials such as the toner and the paper dust stuck to the contact portion of the sealing member 1232 and the collection roller 1222, and (2) it is possible to perform the thrust movement on the cleaning blade 1231 at an adequate speed at which the foreign materials such as the toner and the paper dust stuck between the cleaning blade 1231 and the surface of the collection roller 1222 can be removed.

As described above, in the belt cleaning device 120 according to the present embodiment, the thrust cycles of the cleaning blade 1231 and the collection roller 1222 can be individually optimized, and the foreign materials stuck to the contact portions between the cleaning blade 1231 and the collection roller 1222 and between the sealing member 1232 and the collection roller 1222 can be efficiently cleaned. Thereby, it is possible to prevent toner from scattering and falling from the belt cleaning device 120.

The sealing member 1232 is installed in contact with the surface of the collection roller 1222. When the foreign materials such as paper dust are stuck to such a contact portion, the toner scraped off by the cleaning blade may flow back toward the collection roller and cause toner to scatter and fall. However, unlike the cleaning blade 1231, the sealing member 1232 is very weakly in contact with the surface of the collection roller 1222. As such, if the foreign materials are stuck to such a contact portion, it is difficult to clean the foreign materials. Since the sealing member 1232 is fixed to the case of the intermediate transfer cleaning unit, the thrust movement of the sealing member 1232 is mechanically complicated. Further, as the sealing member 1232 itself is thrust, the toner may be scattered from a gap of the contact portion.

For example, to realize a constitution in which the sealing member 1232 formed of a soft material having flexibility is thrust with its tip maintained in contact with the surface of the collection roller 1222, a complicated mechanism is required. However, in the present embodiment, since the side of the collection roller 1222 is thrust rather than the sealing member 1232, the thrust mechanism 20 can be made into a relatively simple constitution. Further, if the collection roller 1222 is thrust relative to the sealing member 1232 at a thrust speed at which proper cleaning performance is obtained by the cleaning blade 1231, a load applied to the sealing member 1232 is increased. However, in the present embodiment, since the thrust cycle of the collection roller 1222 is set to be longer than that of the cleaning blade 1231, the removal of the paper dust between the sealing member 1232 and the surface of the collection roller 1222 can be accurately performed without applying a great load to the sealing member 1232, while the proper cleaning performance is secured by the cleaning blade 1231.

Accordingly, according to the embodiment, without complicating the structure of the belt cleaning device 120, image defects caused by poor cleaning, or the toner scattering and falling from the intermediate transfer cleaning unit can be more reliably prevented than in the related art.

The present disclosure is not limited to the constitution of the embodiment, and various modifications are possible. For example, one embodiment of the image forming apparatus according to the present disclosure has been described using a multifunction peripheral. However, this is merely one example. For example, another image forming apparatus such as a printer, a copier, or a facsimile device may be used.

Further, in the embodiment, the constitution and processing shown in the embodiment using FIGS. 1 to 15 are merely one embodiment of the present disclosure, and the contents of the present disclosure are not intended to limit to the constitution and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A belt cleaning device comprising:

a collection roller rotated by a rotational driving force from a drive source and electrically adsorbing and collecting remaining toner on an intermediate transfer belt;

a cleaning blade which extends along a rotating shaft of the collection roller and a tip of which comes into contact with a surface of the collection roller under pressure and scrapes off the toner adsorbed to the surface of the collection roller rotated by the driving force from the drive source;

a sealing member which extends along the rotating shaft of the collection roller and a tip of which softly comes into contact with the surface of the collection roller and prevents counterflow of the toner scraped off by the cleaning blade;

a first thrust mechanism thrusting the collection roller in a direction of the rotating shaft of the collection roller by the rotational driving force transmitted to the collection roller; and a second thrust mechanism thrusting the cleaning blade in the direction of the rotating shaft of the collection roller in a thrust cycle shorter than that of the collection roller based on the first thrust mechanism by the rotational driving force transmitted to the collection roller.

2. The belt cleaning device according to claim 1, wherein:

the first thrust mechanism includes a first thrust cam gear that is rotated by the driving force from the drive source and thrusts the collection roller in a predetermined thrust cycle; and the second thrust mechanism includes a cam follower mounted on one end of the cleaning blade, and a second thrust cam gear that has a cam formed on a face facing the cam follower and is rotated by engagement with the first thrust cam gear, the cam coming into contact with the cam follower and thrusting the cleaning blade in the thrust cycle shorter than that of the collection roller.

3. The belt cleaning device according to claim 2, wherein:

the first thrust cam gear with which the first thrust mechanism is equipped includes a first gear mounted on the rotating shaft of the collection roller and integrally rotated with the rotating shaft by the driving force from the drive source, thrust adjusting gears that have cams formed on faces facing the first gear, mounted on respective opposite sides of the first gear while loosely fitted around the rotating shaft of the collection roller, each have a number of teeth different from that of the first gear, and are rotated by the driving force from the drive source, and a gear guide that supports the thrust adjusting gears with the thrust adjusting gears sandwiched from opposite sides thereof and restricts the thrust adjusting gears to move in the direction of the rotating shaft of the collection roller;

the opposite sides of the first gear include respective cam followers; and the cams of the thrust adjusting gears slide with the cam followers of the first gear, and displace the first gear with the collection roller and the rotating shaft of the collection roller between both of the thrust adjusting gears in the direction of the rotating shaft of the collection roller.

4. The belt cleaning device according to claim 3, wherein the number of teeth of the first gear and the thrust adjusting gears are changed mutually so that the thrust cycle of the collection roller is changed.

5. An image forming apparatus comprising:

an intermediate transfer unit including an intermediate transfer belt;

an image forming unit disposed to face the intermediate transfer belt; and a belt cleaning device, wherein the belt cleaning device includes:

a collection roller rotated by a rotational driving force from a drive source and electrically adsorbing and collecting remaining toner on an intermediate transfer belt;

a cleaning blade which extends along a rotating shaft of the collection roller and a tip of which comes into contact with a surface of the collection roller under pressure and scrapes off the toner adsorbed to the surface of the collection roller rotated by the driving force from the drive source;

a sealing member which extends along the rotating shaft of the collection roller and a tip of which softly comes into contact with the surface of the collection roller and prevents counterflow of the toner scraped off by the cleaning blade;

a first thrust mechanism thrusting the collection roller in a direction of the rotating shaft of the collection roller by the rotational driving force transmitted to the collection roller and; and a second thrust mechanism thrusting the cleaning blade in the direction of the rotating shaft of the collection roller in a thrust cycle shorter than that of the collection roller based on the first thrust mechanism by the rotational driving force transmitted to the collection roller.

* * * * *